United States Patent [19]

Riehl

[11] Patent Number: 5,039,300

[45] Date of Patent: Aug. 13, 1991

[54] PILOT BURNER CONSTRUCTION AND METHOD OF MAKING THE SAME

[75] Inventor: Fred Riehl, Greensburg, Pa.

[73] Assignee: Robertshaw Controls Company, Richmond, Va.

[21] Appl. No.: 491,494

[22] Filed: Mar. 12, 1990

[51] Int. Cl.[5] ..... F23D 14/62

[52] U.S. Cl. ..... 431/354; 431/80; 431/264

[58] Field of Search ..... 431/354, 80, 79, 76, 431/264, 343

[56] References Cited

U.S. PATENT DOCUMENTS

| | | | |
|---|---|---|---|
| 3,291,649 | 12/1966 | Craemer et al. | 431/80 |
| 3,308,871 | 3/1967 | Riehl | 158/143 |
| 3,521,982 | 7/1970 | Dunn | 431/80 |
| 3,689,193 | 9/1972 | Riehl | 431/42 |
| 4,298,336 | 11/1981 | Riehl | 431/264 |
| 4,337,029 | 6/1982 | McElroy et al. | 431/80 |

*Primary Examiner*—Larry Jones

*Attorney, Agent, or Firm*—Candor, Candor & Tassone

[57] ABSTRACT

A pilot burner construction and method of making the same are provided, the pilot burner construction comprising a mounting section, a mixer tube section, a flame shield section and a sensing bulb holding section, the pilot burner construction having structure interconnecting all of the sections together to provide a self-contained pilot burner construction, the pilot burner construction comprising two one-piece homogeneous parts secured together to define the mixer tube section therebetween and to define the structure that interconnects the sections together, the two parts also defining the mounting section, the flame shield section and the sensing bulb holding section.

9 Claims, 3 Drawing Sheets

PILOT BURNER CONSTRUCTION AND METHOD OF MAKING THE SAME

BACKGROUND OF THE INVENTION

1. Field of the Invention

This invention relates to a new pilot burner construction as well as to a new method of making such a pilot burner construction.

2. Prior Art Statement

It is known to provide a pilot burner construction comprising a mounting section, a mixer tube section, a flame shield section and a sensing bulb holding section, the pilot burner construction having means interconnecting all of the sections together to provide a self-contained pilot burner construction. For example, see the Riehl U.S. Pat. Nos. 3,308,871; 3,689,193 and 4,298,336.

SUMMARY OF THE INVENTION

It is one of the features of this invention to provide a new pilot burner construction that can be formed from two one-piece homogeneous parts in a simple and effective manner.

In particular, it was found according to the teachings of this invention that a pilot burner construction can be formed from two metallic sheets that are suitably stamped, formed and secured together to define a mounting section, a mixer tube section, a flame shield section and a sensing bulb section that are interconnected together by the two parts with those two parts defining the mixer tube section therebetween.

For example, one embodiment of this invention comprises a pilot burner construction comprising a mounting section, a mixer tube section, a flame shield section and a sensing bulb holding section, the pilot burner construction having means interconnecting all of the sections together to provide a self-contained pilot burner construction, the pilot burner construction comprising two one-piece homogeneous parts secured together to define the mixer tube section therebetween and to define the means that interconnect the sections together, the two parts also defining the mounting section, the flame shield section and the sensing bulb holding section.

Other features of this invention are to respectively provide unique structures for the various sections of a pilot burner construction as will be apparent hereinafter.

Accordingly, it is an object of this invention to provide a new pilot burner construction having one or more of the novel features of this invention as set forth above or hereinafter shown or described.

Another object of this invention is to provide a new method of making a pilot burner construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENT

Figure 1:
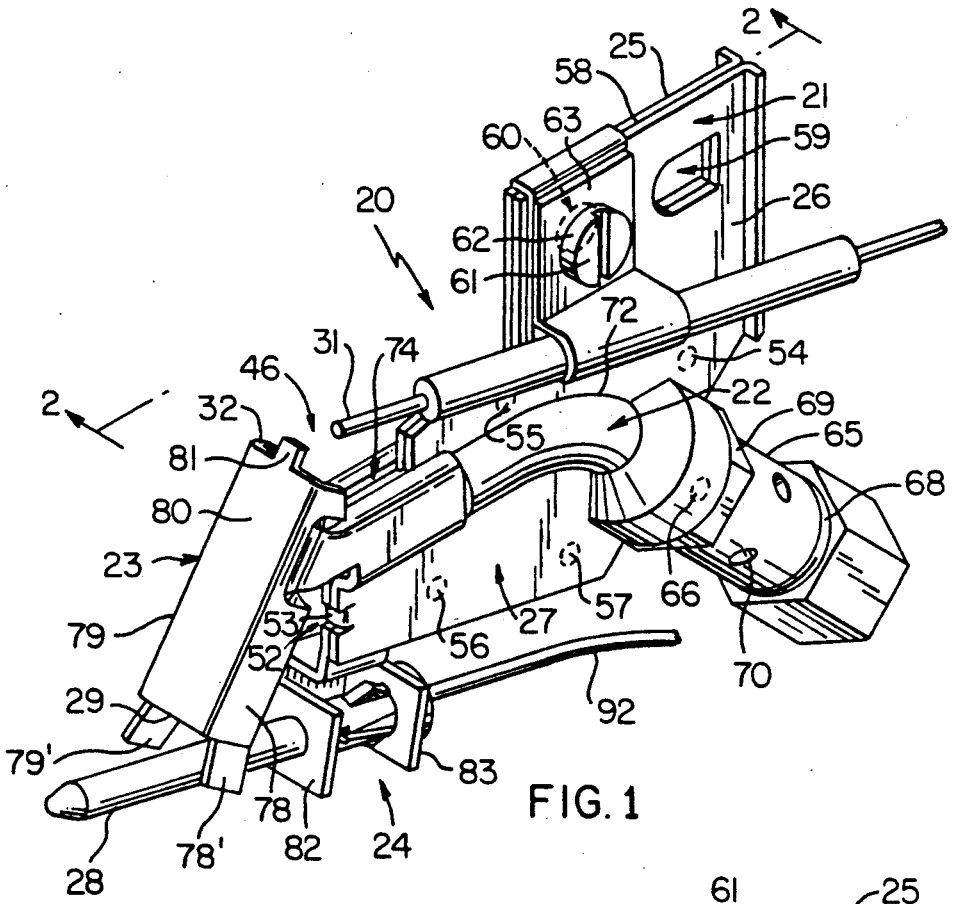
FIG. 1 is a side perspective view of the new pilot burner construction of this invention.

While the various features of this invention are hereinafter illustrated and described as being particularly adapted to provide a pilot burner construction for burning gaseous fuel, such as natural or synthetic gas in a cooking apparatus, it is to be understood that the various features of this invention can be utilized singly or in various combinations thereof to provide a pilot burner construction for other types of apparatus as desired.

Therefore, this invention is not to be limited to only the embodiment illustrated in the drawings because the drawings are merely utilized to illustrate one of the wide variety of uses of this invention.

Referring now to FIGS. 1–7, the new pilot burner construction of this invention is generally indicated by the reference numeral 20 and comprises a mounting section that is generally indicated by the reference numeral 21, a mixer tube section that is generally indicated by the reference numeral 22, a flame shield section that is generally indicated by the reference numeral 23, and a sensing bulb holding section that is generally indicated by the reference numeral 24, the pilot burner construction 20 being formed from two one-piece homogeneous parts 25 and 26 secured together in a manner hereinafter set forth to define the mixer tube section 22 therebetween and to define structure that is generally indicated by the reference numeral 27 that interconnects the sections 21–24 together in a manner hereinafter set forth. The two parts 25 and 26 also define the mounting section 21, the flame shield section 23 and the sensing bulb holding section 24 in a manner hereinafter set forth.

Figure 2:
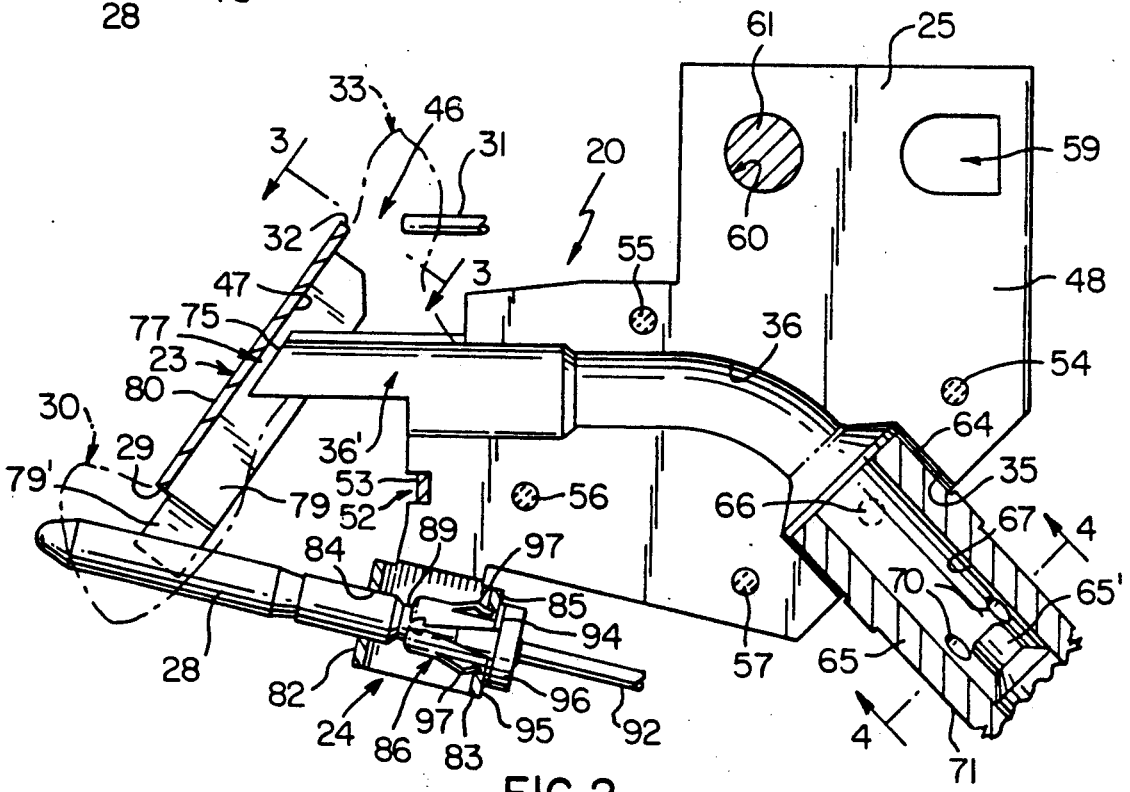
FIG. 2 is an enlarged fragmentary cross-sectional view taken on line 2—2 of FIG. 1.
Figure 6:
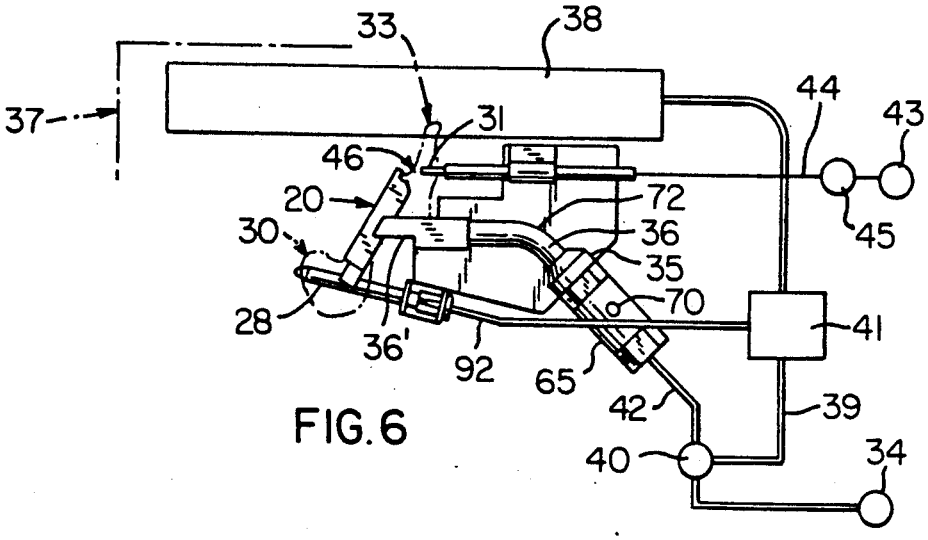
FIG. 6 is a schematic view illustrating a cooking apparatus having an electrical and burner control system therein and utilizing the pilot burner construction of FIGS. 1–5 therein.

The sensing bulb holding section 24 of the pilot burner construction 20 of this invention is adapted to hold a flame sensing bulb 28 adjacent a lower end 29 of the flame shield section 23 for sensing the presence of a relatively large heater flame that is generally indicated by the reference numeral 30 in FIGS. 2 and 6 while the mounting section 21 of the pilot burner construction 20 is adapted to hold an electrode 31 adjacent an upper end 32 of the flame shield section 23 to ignite fuel issuing adjacent the end 32 of the flame shield section 23 to produce an ignition flame that is generally indicated by the reference numeral 33 in FIG. 2, the fuel for producing the flames 30 and 33 being supplied from a fuel source 34, FIG. 6, and being directed into an inlet end 35 of a passage means 36 of the mixer tube section 22 to issue out of an outlet end thereof that is generally indicated by the reference numeral 36' in FIG. 2 in a manner hereinafter set forth.

The pilot burner construction 20 of this invention can be utilized in a cooking apparatus that is generally indicated by the reference numeral 37 in FIG. 6 and comprising a main burner means 38 that is adapted to be fed fuel from the fuel source 34 through a fuel source conduit means 39 that has a fuel control valve device 40 therein and a safety valve device 41 also therein upstream from the fuel control device 40, the safety valve device 41 only interconnecting the fuel source conduit 39 to the main burner means 38 when the flame sensing bulb 28 senses the large heater flame 30 at the pilot burner means 20 in a manner well known in the art. For example, see the aforementioned three Riehl U.S. Pat. Nos. 3,308,871; 3,689,193 and 4,298,336, whereby these three U.S. patents are being incorporated into this disclosure by this reference thereto.

Fuel is also adapted to be supplied from the fuel source conduit means 39 to the pilot burner construction 20 by the fuel control device 40 interconnecting the fuel source conduit means 39 to a branch conduit 42 that leads to the inlet end 35 of the passage 36 of the pilot burner construction 20. In particular, when the fuel control device 40 is in an "on" condition thereof, sufficient fuel is directed from the fuel source 34 to the pilot burner construction 20 to create a small continuously burning standby flame 33 which will be subsequently increased in size for ignition purposes as well as to create the large heater flame 30 when the thermostatic means of the fuel control device 40 determines that the output temperature effect of the burner means 38 for the cooking apparatus 37 has fallen below the output temperature setting of the fuel control device 40 whereby the large heater flame 30 causes the safety valve device 41 to open and feed fuel to the main burner means 38 that issues therefrom and is ignited by the large ignition flame 33 of the pilot burner construction 20. Conversely, when the output temperature effect of the burner means 38 of the cooking apparatus 37 is above the selected setting of the fuel control device 40, the fuel control device 40 reduces the flow of fuel to the pilot burner construction 20 so that the same will only maintain the small standby flame 33 whereby the safety valve 41 will close and thereby prevent further fuel from issuing from the main burner means 38 until a large heater flame 30 is again created by the pilot burner construction 20.

In this manner, the main burner means 38 is cycled on and off by the pilot burner construction 20 under the control of the fuel control device 40 so as to tend to maintain an output temperature effect of the burner means 38 determined by the temperature setting of the control device 40. For example, the burner means 38 can be utilized to heat an oven (not shown) of the cooking apparatus 37 in a manner well known in the art.

Should the electrode 31 be utilized with the pilot burner construction 20 of this invention for the cooking apparatus 37 of FIG. 6, it can be seen that the electrode 31 can be supplied with electrical energy from an electrical source 43 through a lead means 44 by an electrical control means 45 to cause sparking across a gap 46 that is formed between the electrode 31 and the end 32 of the flame shield section 23 of the pilot burner construction 20 to initially ignite the fuel issuing from the outlet means 36' of the passage 36 of the pilot burner construction 20 to create the standby flame 33 when the control device 40 is initially turned from an "off" condition thereof to an "on" condition thereof in a manner well known in the art.

However, once the small standby flame 33 is created at the pilot burner construction 20, the standby flame 33 causes suitable ionization to take place in the air gap 46 in a manner well known in the art to dissipate any buildup of electrical current in a spark-creating capacitor of the control means 45 so that further sparking between the probe electrode 31 and the end 32 of the flame shield section 23 will not take place as long as a flame 33 exists at the outlet means 36'.

Of course, when the control device 40 increases the flow of fuel to the pilot burner means 20 so as to create the large heater flame 30, such increased flow of fuel impinges against an inside surface 47 of the flame shield section 23 so as to be directed upwardly to the end 32 thereof as well as downwardly toward the end 29 thereof to create the heater flame 30. The increased flow of fuel to the end 32 of the flame shield section 23 increases the size of the flame 33 so as to provide sufficient flame means for igniting the fuel subsequently issuing from the main burner means 38 all in a manner well known in the art as set forth in the aforementioned three Riehl U.S. patents.

Therefore, since the operation of the cooking apparatus 37 utilizing a pilot burner construction is well known in the art as provided by the teaching set forth in the aforementioned three Riehl U.S. patents, a further description of the operation of the pilot burner construction 20 of this invention need not be set forth.

Figure 7:
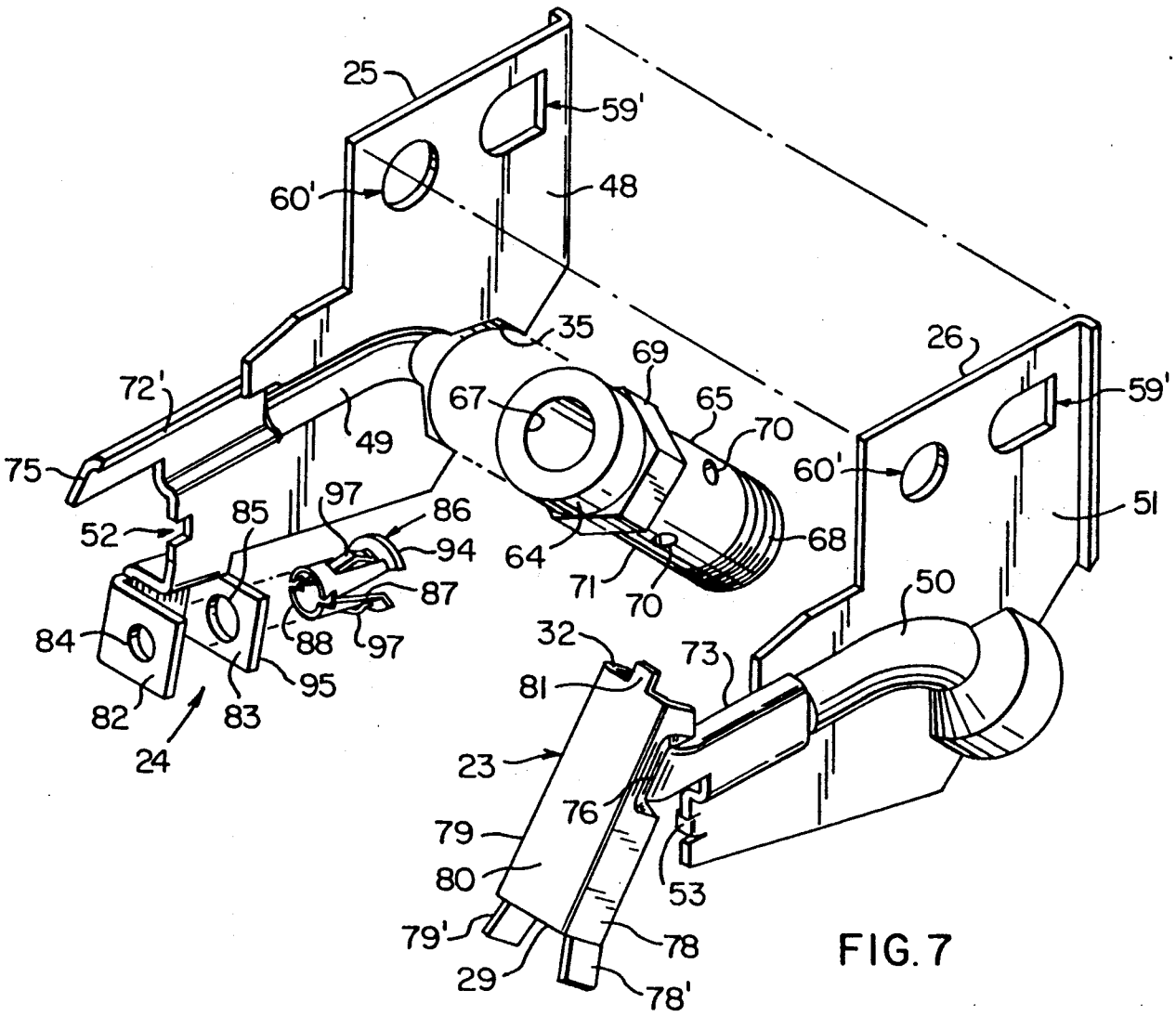
FIG. 7 is an exploded perspective view of the various parts of the pilot burner construction of FIGS. 1–5.

The two parts 25 and 26 that form the pilot burner construction 20 of this invention can comprise two sheets of metallic material suitably stamped and formed in the manner illustrated in FIG. 7 and, in one working embodiment of the pilot burner construction 20 of this invention, the parts 25 and 26 each comprise a strip or sheet of stainless steel, RMS-419, that is approximately 0.031 of an inch thick and which defines a straight line length from the inlet end 35 to outlet end 36' of the passage of approximately 1.900 inches long.

As illustrated in FIG. 7, the sheet 25 has a flat surface 48 deformed to define a depression 49 that cooperates with a like depression 50 deformed in a facing flat side 51 of the part 26 to form the passage 36 when the facing sides 48 and 51 are disposed together and the depressions 49 and 50 are disposed in aligned relation as illustrated in the drawings.

In order to facilitate the orientation of the parts 25 and 26 into their superimposed aligned relation, the part 25 is provided with a rectangular notch 52 while the part 26 has a tab 53 carved therefrom and bent so that the same will be received in the notch 52 in the manner illustrated in FIG. 1 to properly orient the two parts 25 and 26 together to align the depressions 49 and 50 together to form the passage means 36 of the mixer tube section 22.

In order to secure the parts 25 and 26 together in their superimposed relation, the two parts 25 and 26 can be resistance welded together, such as in four spot areas 54, 55, 56 and 57 as illustrated in the drawings.

When the parts 25 and 26 are secured together in the above manner, the same define a longitudinal cross-sectional center line or seam 58 of the pilot burner construction 20 as illustrated and the mixer tube section 22 is defined between the secured together parts 25 and 26.

The resulting mounting section 21 of the pilot burner construction 20 is defined by a D-shaped opening means 59 and a circular opening means 60 to be utilized for mounting the structure 20 adjacent the main burner means 38 all in a manner well known in the art, the opening means 59 and 60 being respectively defined by aligned openings 59' and 60' formed respectively in the parts 25 and 26 as illustrated which align together when the parts 25 and 26 are secured together in the manner previously set forth.

A threaded fastening screw 61 can be disposed in the circular opening means 60 to threadedly mount the pilot burner construction 20 to the desired supporting structure in a manner well known in the art, the mounting screw 61 being adapted to have its enlarged head 62 mount a clip 63 to the mounting section 21 with the clip 63 holding the electrode means 31 in position as illustrated in the drawings whereby it can be seen that the electrode means 31 can be attached to the mounting section 21 of the pilot burner construction 20 by the same mounting screw 61 which eliminates the need for an additional mounting screw for the spark probe or electrode 31. It also can be seen that the mounting opening means 59 and 60 of the pilot burner construction 20 permits the pilot burner construction 20 to be mounted either on the right or left side of a burner mounting and likewise permits the electrode 31 to be mounted to the right or left side of the pilot burner construction 20 as required.

This feature of left side or right side mounting of the pilot burner construction 20 of this invention is achieved by the center line effect of the two parts 25 and 26 forming the pilot burner construction 20 of this invention and thereby cuts inventory of manufacturing by approximately 50%.

The depressions 49 and 50 in the parts 25 and 26 of the pilot burner construction 20 that form the passage means 36 respectively define the inlet end portion 35 that is substantially cylindrical to receive a cylindrical end 64 of a metallic holder 65 therein which is adapted to be held in position by suitable resistance welding, such as the spot resistance weld spot 66 illustrated in FIG. 1. The holder 65 has a passage 67 passing therethrough and having an end 68 suitably externally threaded so as to threadedly couple to the branch conduit 42 illustrated in FIG. 6 in a conventional manner.

The holder 65 has an intermediate hex-like section 69 for facilitating the coupling to the conduit 42 and is adapted to hold an orifice means 65', FIG. 2, therein for fuel injection purposes as is well known in the art.

In addition, the holder 65 has a plurality of primary air intake openings 70 formed through an external peripheral surface 71 thereof and joining with the passage 67, the primary air openings 70 being located approximately 45° apart and thereby minimize cross currents of air flow versus orifice fuel injection to provide more predictable flame characteristics for all types of gases.

The passage 36 of the mixer tube section 22 of the pilot burner construction 20 of this invention has an intermediate or elbow portion 72 that is angled at approximately 45° intermediate the inlet end 35 and outlet end 36' of the passage 36 and has two main advantages.

In particular, the angled portion 72 places the primary air intake openings 70 at a lower position relative to the ports of the main burner 38 as illustrated in FIG. 6 and thereby reduces the intake of combustion byproducts of the main burner 38 into the primary air intake openings 70.

The other main advantage of the 45° angled mixer portion 72 is that the same provides improved gas mixtures by preventing a laminar orifice flow injection, the turbulence pattern being created by the angled bend portion 72 prior to issuance into the flame shield section 23 of the pilot burner construction 20 insuring a uniform flame character and gas-to-air mixture.

The outlet end 36' of the passage 36 of the mixer tube section 22 of the pilot burner construction 20 of this invention is defined by edge means 72' and 73 of the parts 25 and 26 being deformed so as to be slightly spaced from each other to define a gap 74 therebetween when the parts 25 and 26 are secured together in the manner illustrated in FIG. 1 so that the small standby flame 33 can issue from the same adjacent the end 32 of the flame shield section 23.

However, the edge means 72' and 73 of the parts 25 and 26 respectively have ends 75 and 76 with the end 76 of the part 26 being integrally interconnected to the flame shield section 23 which is carried thereby while the end 75 of the part 25 is disposed spaced from the surface 47 of the flame shield section 23 by a gap 77 as illustrated in FIG. 2 so that the fuel issuing from the passage 36 in an increased flow manner will impinge against the side 47 of the flame shield section 23 so as to divide into the large upper ignition flame 33 ad the large lower heater flame 30 as previously set forth.

Figure 3:
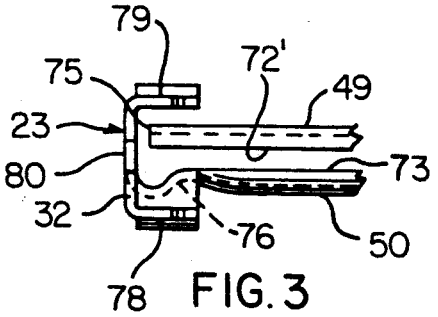
FIG. 3 is a fragmentary cross-sectional view taken on line 3—3 of FIG. 2.
Figure 4:
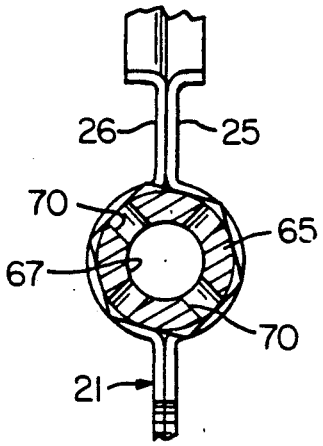
FIG. 4 is a fragmentary cross-sectional view taken on line 4—4 of FIG. 2.
Figure 5:
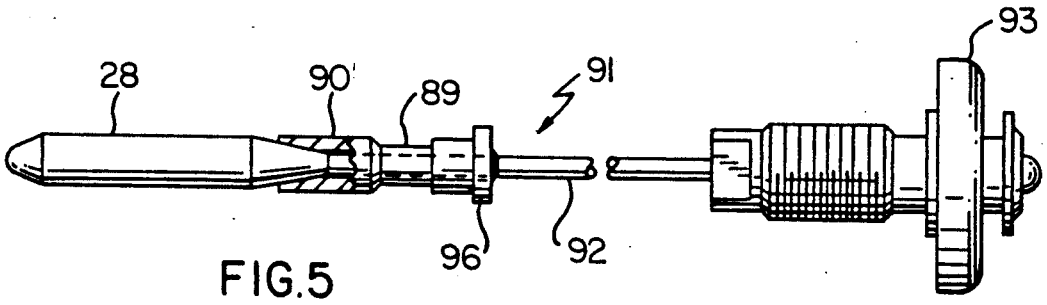
FIG. 5 is a side view of the temperature sensing bulb structure utilized with the pilot burner construction of this invention.

The flame shield section 23 is substantially U-shaped as illustrated in FIG. 3 and is defined by two side parallel flat portions 78 and 79 joined together by an intermediate flat portion 80 that defines the entire inside surface 47 as illustrated in FIG. 2, the flame shield section 23 merely being bent into the configuration illustrated so that the side portion 79 overlaps the free end 75 of the part 25 as illustrated in FIG. 2 whereby the side portions 78 and 79 cooperate with the end portion 80 to define a U-shape around the outlet portion 36' of the passage 36 of the mixer tub section 22 as illustrated.

The end portion 80 of the flame shield section 23 is provided with a tang 81 at the end 32 of the flame shield section 23 to provide a point for cooperating with the electrode 31 for sparking purposes in manner well known in the art. In addition, the side portions 78 and 79 of the flame shield section 23 are provided with tab-like portions 78' and 79' adjacent the end 29 of the flame shield section 23 to confine the flame sensing bulb 28 in the heater flame 30 area as illustrated in FIGS. 1 and 2.

By properly angling the portion 80 of the flame shield means 23 relative to the axis of the outlet 36' of the passage 36, such as approximately 55°, the surface 47 of the flame shield section 23 acts as a turbulence bar that uniquely insures that the flame pattern formation will create the large ignition flame 33 before the heater flame 30 is formed so that the sensing bulb 28 will not be heated without an ignition flame 33 being present thereby preventing delayed ignition hazards.

Thus, it can be seen that the flame shield section 23 of the pilot burner construction 20 is carried solely by the part 26 thereof.

The bulb holding section 24 of the pilot burner construction 20 of this invention is carried solely by the part 25 of the pilot burner construction 20 and is defined by a pair of tabs 82 and 83 disposed in the spaced apart relation as illustrated in FIGS. 1, 2 and 7 and respectively having openings 84 and 85 passing therethrough in aligned relation, the opening 84 being of a size to permit the bulb 28 to pass therethrough while the opening 85 is of a size to permit a split spring clip means 86 to be disposed therein, the clip 86 being split on one side as represented by the reference numeral 87 in FIG. 7 to permit the same to have the end 88 thereof disposed around a reduced cylindrical portion 89 of a sleeve portion 90 of a bulb assembly 91 that comprises the flame sensing bulb 28 and a capillary portion 92 that leads to a diastat assembly 93 in a manner well known in the art, the diastat assembly 93 forming part of the safety valve means 41 also in a manner well known in the art.

In this manner, the clip 86 is adapted to pass through the opening 85 until an enlarged end 94 thereof abuts against a side 95 of the tab 83 in the manner illustrated in FIG. 2 to position the clip 86 intermediate the tabs 82 and 83 while an enlarged flange part 96 of the bulb sleeve 90 also abuts against the end 94 of the clip 86 as illustrated in FIG. 2 to properly position the bulb 28 relative to the end 29 of the flame shield section 23, the clip 86 having spring tabs 97 for holding the clip 86 in the position illustrated in FIG. 2 in a manner well known for split spring clip means whereby the sensing bulb 28 can be easily assembled to or disassembled from the pilot burner construction 20 in the field for replacement thereof, if desired.

Thus, it can be seen that the pilot burner construction 20 of this invention, through the stamped design thereof, provides a simplified manufacturing process that eliminates many of the assembly operations necessary to produce a comparable conventionally constructed pilot burner construction thereby making the pilot burner construction 20 of this invention less costly to produce while improving performance reliability whereby the pilot burner construction 20 of this invention is believed to be a step forward in the present state of the art due to the simplification of the assembly and improved performance relative to comparable products now in use.

While the pilot burner construction 20 has been previously described as having an electric spark ignition capability, it is to be understood that the same can be utilized as a standing pilot application without having an electrical spark ignition capability, if desired.

Therefore, it can be seen that this invention not only provides a new pilot burner construction but also this invention provides a new method of making such a pilot burner construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a pilot burner construction comprising a mounting section, a mixer tube section, a flame shield section and a sensing bulb holding section, said pilot burner construction having means interconnecting all of said sections together to provide a self-contained pilot burner construction, said pilot burner construction comprising two one-piece homogeneous parts secured together to define said mixer tube section therebetween and to define said means that interconnect said sections together, said two parts also defining said mounting section, said flame shield section and said sensing bulb holding section, said mounting section having opening means passing therethrough, said pilot burner construction comprising a threaded fastening member having a portion thereof disposed in said opening means to mount said pilot burner construction to the desired support structure, said pilot burner construction comprising an electrode means for igniting fuel that will issue from said pilot burner construction, the improvement wherein said pilot burner construction comprises a clip having a first portion holding part of said electrode means against said mounting section and a second portion having an opening therethrough and being aligned with said opening means of said mounting section and receiving part of said fastening means therein whereby said fastening means is adapted to fasten said clip to said mounting section and also is adapted to fasten either side of said pilot burner construction against said support structure.

2. A pilot burner construction as set forth in claim 1 wherein said two parts define therebetween a longitudinal centerline of said pilot burner construction.

3. A pilot burner construction as set forth in claim 1 wherein said two parts are each formed of metallic material.

4. A pilot burner construction as set forth in claim 1 wherein said two parts are each formed from a sheet of stainless steel that is cut and stamped and bent to form its respective portions of said sections.

5. A pilot burner construction as set forth in claim 1 wherein one of said two parts has a notch formed therein and the other of said two parts has a tab carved and bent therefrom and being disposed in said notch to orient said two parts together.

6. A pilot burner construction as set forth in claim 1 wherein said flame shield section is formed solely by one of said two parts.

7. A pilot burner construction as set forth in claim 1 wherein said sensing bulb holding section is formed solely by one of said two parts.

8. A pilot burner construction as set forth in claim 1 wherein said mixer tube section comprises a depression formed in each said part from one end thereof to another end thereof and being aligned with said depression formed in the other of said two parts to define a closed passage from one end of said pilot burner construction to an outlet end of said passage where said flame shield section is located.

9. A pilot burner construction as set forth in claim 8 wherein said passage is angled between said one end thereof and said outlet end thereof.

* * * * *